United States Patent [19]

Corain

[11] 4,417,606

[45] Nov. 29, 1983

[54] WEFT PROPELLING GRIPPERS FOR TEXTILE LOOMS

[75] Inventor: Luciano Corain, Vicenza, Italy

[73] Assignee: Nuovo Pignone S.p.A., Florence, Italy

[21] Appl. No.: 296,211

[22] Filed: Aug. 25, 1981

[30] Foreign Application Priority Data

Sep. 15, 1980 [IT] Italy ..... 24661 A/80

[51] Int. Cl.[3] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 4,040,454 | 8/1977 | Genini | 139/448 |
| 4,071,055 | 1/1978 | Haltmeier et al. | 139/448 |
| 4,129,155 | 12/1978 | Merisio | 139/448 |
| 4,235,261 | 11/1980 | Genini | 139/448 |
| 4,271,873 | 6/1981 | Genini | 139/448 |

*Primary Examiner*—Henry Jaudon

*Attorney, Agent, or Firm*—Hedman, Casella, Gibson, Costigan & Hoare

[57] ABSTRACT

Weft inserting and withdrawing grippers for a shuttleless weaving machine are disclosed, wherein the weft inserting gripper has a clamping member composed of pivoting blade-type foot biased by a spring and mounted in such a way that the foot bears against a horizontal gripping surface at an angle nearly equal to the complementary of the angle of friction between the yarn and the gripping surface. The gripping member of the withdrawing gripper has a hook with a wedge which can be axially slid towards and away from the hook to seize and hold the thread, or to clear it. The axial sliding motion of the wedge is controlled by a linkage which is resiliently biased by a spring.

5 Claims, 12 Drawing Figures

A
A
1
2
3
3'
4
4'
5
6
7
8
9
10
11
12
12'
12''
α

WEFT PROPELLING GRIPPERS FOR TEXTILE LOOMS

FIELD OF THE INVENTION

This invention relates to the two weft propelling grippers, namely the inserting and withdrawing grippers, which in a shuttleless textile loom respectively grip the weft yarn outside the shed and insert it into said shed, then changing-over with each other at the centre of the shed.

More specifically, the invention relates to improvements in the weft yarn gripping and clamping members of said weft propelling grippers.

BACKGROUND OF THE INVENTION

In the field of modern shuttleless textile looms operating at high speed, it is well known that the effective clamping of the weft yarn by the weft propelling grippers is one of the problems most difficult to solve in that considerable difficulties are present due to technical requirements which are of opposite character.

In this respect, because weft yarn generally does not have a very great strength, it is required to enter smoothly at low tension between the gripping members of the gripper so that it does not undergo damage.

On the other hand, in order to prevent the weft yarn from being able to withdraw from the clamping members of the gripper because of either the tension necessary for unwinding the weft yarn from the reel or the tension induced by the necessary weft braking devices, or because of tearing, vibration or intense acceleration, it is necessary for said clamping members of the gripper to retain the weft reliably by clamping it strongly. In addition, account must be taken of the fact that the grippers slide along the loom sley which in its turn rotates in a direction orthogonal to its length. Thus from the time the inserting gripper grips the weft yarn which is stretched between the reel and the edge of the fabric under formation until the time the yarn is cut by the edge of said fabric, said weft yarn must be able to slide easily between the gripping members of the inserting gripper in the direction from the reel to the fabric edge, in order to enable the gripper to travel through its curved path without tearing the weft yarn which is still fixed to the edge of the fabric. Thus, in order to enable the insertion of the weft yarn into the inserting gripper, the retention of said yarn during its transportation, and the transfer of the weft yarn from the inserting gripper to the withdrawing gripper at the centre of the shed to be effected in an optimum manner, the weft yarn must be able to slide easily between the gripping and clamping members in the longitudinal direction of the inserting gripper. In the transverse direction it must be able to slide easily only in the unwinding direction from the reel, whereas in the other direction, however, the weft yarm must be prefectly blocked. Methods are already known in the state of the art for gripping and clamping the weft yarn.

One of said known methods uses positively controlled gripping and clamping members, i.e. members which are opened by suitable external control devices in order to receive or release the weft yarn, whereas strong springs provide for keeping the members firmly clamped together during the other stages. Although such members perfectly satisfy the requirement of gripping and releasing the yarn smoothly, and of retaining it firmly during its transportation, they have a series of considerable drawbacks due substantially to the enormous difficulty of operating the gripping and clamping members in phase with the external control devices, especially in the change-over of the yarn between the weft inserting and withdrawing grippers at the centre of the shed, because of the high loom speed and in particular because of the fact that slack inevitably arises between the various mechanical members. In addition to the greater constructional complexity and the consequent greater cost, in these types of member there is also excessive wear and a greater possibility of fracture because they comprise elements which are in contact with each other at the high speed necessary for the drive movements.

According to a further known method, gripping and clamping members are used which are kept constantly closed by suitably set springs which are adjustable. In this case, the closure of the gripping members is obviously a compromise between the requirement to grip and release the weft yarn smoothly, and the requirement to retain it firmly during its transportation. Special accurate controls are therefore necessary in order to attain acceptable operation, and sometimes this latter is even impossible to attain because of the characteristics of particular irregular heavy yarns such as those used for furnishing fabrics which, requiring high tension for unwinding them from the reel, have to be energetically clamped by the gripping members of the weft inserting and withdrawing grippers.

SUMMARY OF THE INVENTION

The object of the present invention is to obviate the aforesaid drawbacks and to thus obtain technical reliability in the transportation of the weft yarn by the weft inserting and withdrawing grippers without having to use complicated, delicate and costly devices.

More specifically, the invention provides weft yarn gripping and clamping members for the weft inserting and withdrawing grippers which are of simple form and optimum operation.

For purposes of the following explanation, the outer side of a weft inserting gripper is defined as that side of the gripper from which the cut end of the weft yarn emerges, and the inner side is defined as that side of the inserting gripper reached by the weft yarn originating from the feed reel. In view of these orientation definitions the weft yarn gripping and clamping members of the weft inserting gripper of the present invention are constituted by a horizontal gripping surface present longitudinally on the other side of the gripper, and with which there cooperates a vertical blade-type foot hinged upperly to a rotation pivot disposed parallel to said horizontal gripping surface and supported by the gripper body. The blade-type foot has a height greater than the distance of said rotation pivot from said horizontal gripping surface. The height of the blade-type foot is such as to cause it to form with the gripping surface an angle approximately equal to the complementary of the angle of friction between the yarn and horizontal gripping surface. The blade-type foot is kept resting against said horizontal gripping surface and inclined outwards from the outer side of the inserting gripper by means of a thrust spring which is supported by the gripper body and presses against the inclined face of the blade-type foot.

The advantages of such gripping and clamping members are immediately apparent. In this respect, the weft yarn can now easily slide between said horizontal gripping surface and said blade-type foot, both in the longitudinal direction of the gripper and thus of said horizontal gripping surface, and in the transverse direction of the inserting gripper, but only in the direction towards the outer side thereof, i.e. in the direction in which the yarn is unwound from the feed reel, because said blade-type foot is rotated in the direction which withdraws it from the horizontal gripping surface, i.e. in the direction which opens it. Said weft yarn is therefore categorically prevented from withdrawing from the gripper, i.e. sliding in the direction towards the inner side of the gripper, i.e. towards the reel, because of the fact that a withdrawal movement of the weft yarn causes the blade-type foot to rotate against the gripping surface to thus exert a greater grip on the yarn.

Optimum conditions are thus attained.

According to a further characteristic of the present invention, said gripping and clamping members also comprise an arcuate deflector for the weft yarn, which descends inside the gripper body until it reaches the level of said horizontal gripping surface.

The presence of said deflector is essential for correct operation of said gripping and clamping members because the purpose is to bring the weft yarn to the same level as the gripping surface, and thus prevent the weft yarn being able to act on said blade-type foot in the sense of causing it to rotate and thus opening the gripping and clamping members. On the other hand, said deflector also has the further advantage of disposing the weft yarn inside the gripper body in a vertical position, i.e. in the most favourable position for easy hooking by a weft withdrawing gripper provided with a horizontally disposed hook.

According to a further embodiment of the present invention, said blade-type foot is kept resting against said horizonal gripping surface by means of a thrust spring which is pressed against the inclined face of the foot by a lever opposed by a return spring and projecting from the inserting gripper body, and is inserted through a slot provided in said blade-type foot so that the spring extends behind the blade-type foot to beyond the edge of said slot. In this manner, on rotating said lever and consequently said thrust spring against the action of said return spring, it is possible to manually withdraw the blade-type foot from the gripping surface, i.e. to manually open the gripping and clamping members for cleaning reasons.

According to a further characteristic of the present invention, the weft yarn gripping and clamping members of the weft withdrawing gripper are constituted by a wedge which is mobile axially within a hook disposed horizontally on the withdrawing gripper body, said wedge being kept resiliently pressed within said hook by a spring which acts on that end of a lever which extends outside the gripper body. This lever is hinged at its centre to the gripper body, with the end of said wedge being hinged to the other end of said lever. Said hook and said wedge are shaped in such a manner that they form a narrow V inlet between them on one side.

In such gripping and clamping members, the weft yarn which is presented vertically by the weft inserting gripper becomes inserted into the narrow V inlet until it remains firmly trapped therein, and is released by means of an axial opening movement of the wedge relative to the hook which is effected automatically by the action of a cam fixed on to said part of the lever which extends outside the gripper body.

The advantages of such gripping and clamping members are all substantially due to the axial movement between the wedge and hook, which enables the weft withdrawing gripper to be constructed with a very small overall vertical size which remains unchanged whether the gripper is open or closed, thus reducing the contact between the gripper and the warp yarns, and thus the possibility of these latter becoming worn, and also reducing the dimensions of the actual weft inserting gripper into which the withdrawing gripper has to penetrate. Futhermore, the axial closure ensures effective clamping of the weft yarn in that it favours the insertion of the yarn into said V slot. In this respect, as a result of increase in the tension acting on the weft yarn or as a result of the resilience of the hook, the weft yarn tends to become inserted more deeply into the V slot, and thus undergoes increasingly more energetic blocking.

In order to increase the gripping zone of the weft yarn so as to further increase the effectiveness of the gripping of the weft yarn by the withdrawing gripper, according to a further characteristic of the invention, in that part thereof which forms said V inlet with said hook, said wedge is provided with a flat spring rigid therewith.

Finally, according to a preferred embodiment of the invention which enables still more effective clamping of the weft yarn to be attained, in that part thereof which forms said V inlet with said hook, said wedge is provided with a curved flat spring (spirally twisted) disposed longitudinally, one of its ends being bolted to said wedge whereas its other twisted end is inserted into a slot provided in said wedge at said V inlet.

In this manner, the curved flat spring acts against the hook gripping surface by means of its edge, thus enabling a greater squeezing force to be exerted on the yarn.

The inserting and withdrawing grippers of the subject invention cooperate with one another in substantially the conventional manner, with the operational advantages of the inserting and withdrawing grippers being attributable to their structural configuration.

The invention is described in detail hereinafter with reference to the drawings which illustrate a preferred embodiment thereof given by way of non-limiting example only, in that technical or constructional modifications can be made thereto without leaving the scope of the present invention.

DETAILED DESCRIPTION OF THE PREFERRED EMBODIMENTS

Figures 1, 2, 3:
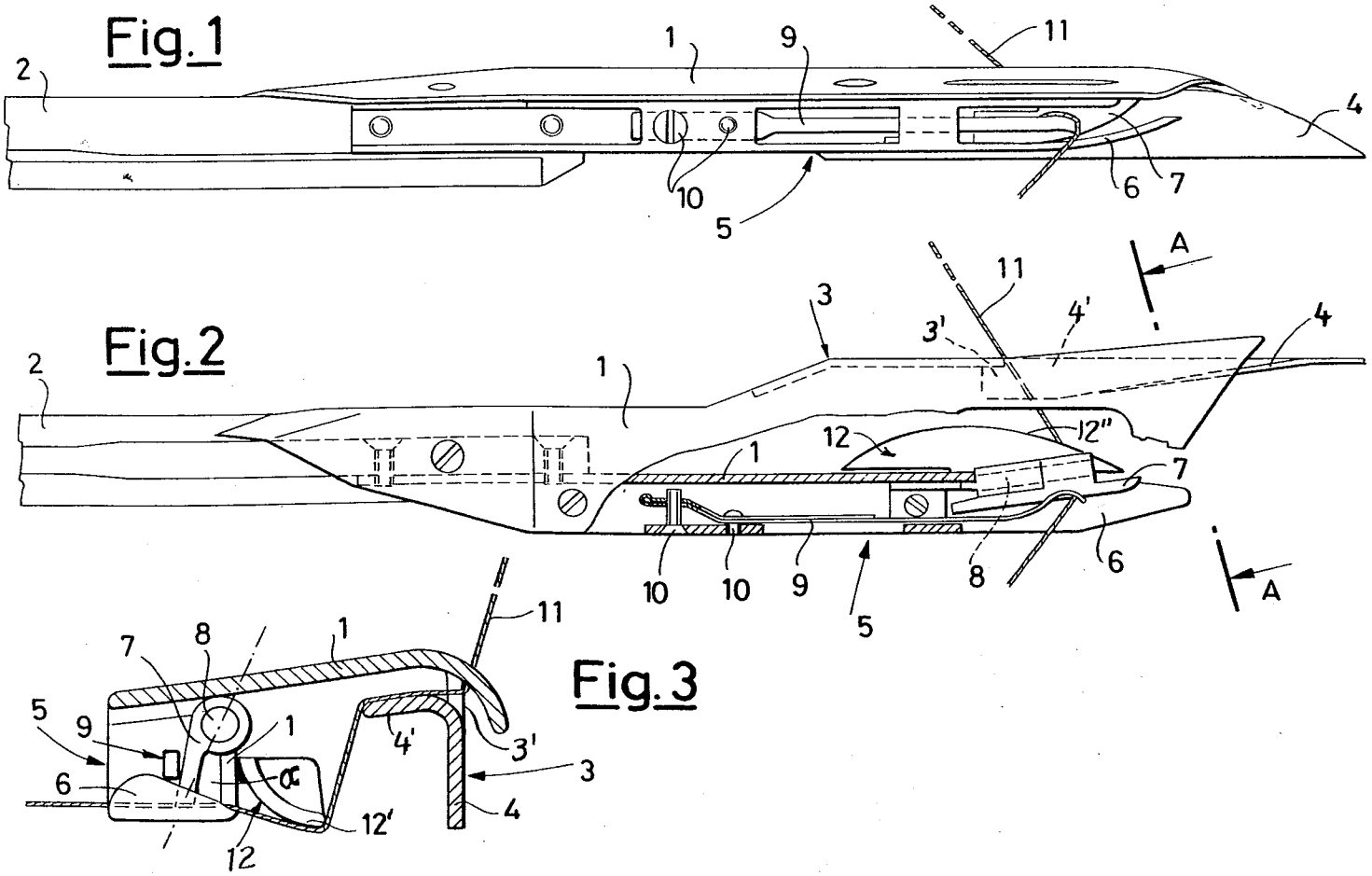
FIG. 1 is a longitudinal side view of a weft inserting gripper using the gripping and clamping members according to the invention.
FIG. 2 is a partially sectional plan view of the weft inserting gripper of FIG. 1.
FIG. 3 is a partial front view on the line AA of FIG. 2.

With reference to the figures, in which equal elements are indicated by the same numeral, the reference numeral 1 indicates the gripper body of a weft propelling guide gripper mounted on the support 2. According to the convention established above, the gripper body 1 has an inner side 3, which is the side nearest the reel from which the weft yarn originates, and an outer side 5, which is the side from which the cut end of the weft yarn emerges. Said gripper body 1 comprises the point 4 on its inner side 3 and a gripping surface 6 on its outer side 5. Side 3 further includes a yarn passageway 3' as shown most clearly in FIGS. 2 and 3.

A vertical blade-type foot 7 is hinged upperly to a rotation pivot 8 supported by the gripper body 1 and disposed parallel to the gripping surface 6 at a distance therefrom which is less than the height of the foot 7, so that the foot 7 rests against the gripping surface 6 at an angle $\phi$ (see specifically FIG. 3) which is chosen approximately equal to the complementary of the angle of friction between the yarn and gripping surface by suitably choosing said height of the foot 7.

Said blade-type foot 7 is kept resting against the gripping surface 6, with its inclination facing outwards from the outer side 5 of the gripper, by means of a thrust spring 9 which is fixed at one end to the gripper member 1 by means of screws 10 and presses at its other end against the outer inclined face of the foot 7.

The weft yarn 11, as shown most clearly in FIG. 3, passes through the yarn passageway 3' in the inner side 3. The weft yarn 11 extends from the passageway 3' across the horizontal portion 4' of the point 4, and then extends approximately vertically to the lower curved edge 12' of the arcuate deflector 12. The arcuate deflector 12 is fixed to the gripper body 1 and descends inside the gripper body 1 until the lower arcuate edge 12' is at or below the level of the horizontal gripping surface 6, such that the yarn 11 becomes disposed substantially as illustrated in FIG. 3 and the blade-type foot 7, and by the effect of an arcuate deflector 12 which is fixed to the gripper body 1 and descends inside the gripper body until it reaches the level of the gripping surface 6, becomes disposed as illustrated in FIG. 3, i.e. in a substantially vertical position.

On the other hand, as can be seen in FIG. 3 it is apparent that the weft yarn 11 can easily slide between the gripper from right to left by rotating the foot 7 in opposition to the action of the spring 9, whereas sliding in the opposite direction, i.e. in the direction in which the yarn is withdrawn from the gripper, is categorically prevented. The weft yarn 11 also can move along the gripping surface 6 in the longitudinal direction of the gripper which is a direction generally parallel to the foot 7 and the pivot 8.

Figure 4:
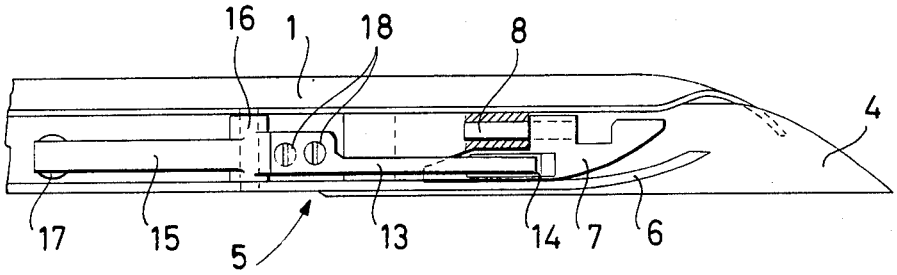
FIG. 4 is a view analogous to that of FIG. 1 but to a large scale, in which the gripping and clamping members comprise a modification according to the invention.
Figure 5:
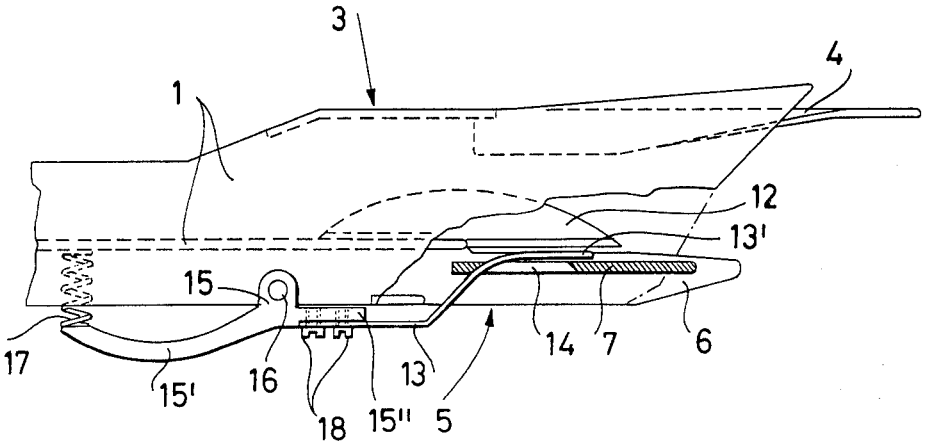
FIG. 5 is a partly sectional plan view of the gripper of FIG. 4.
Figure 6:
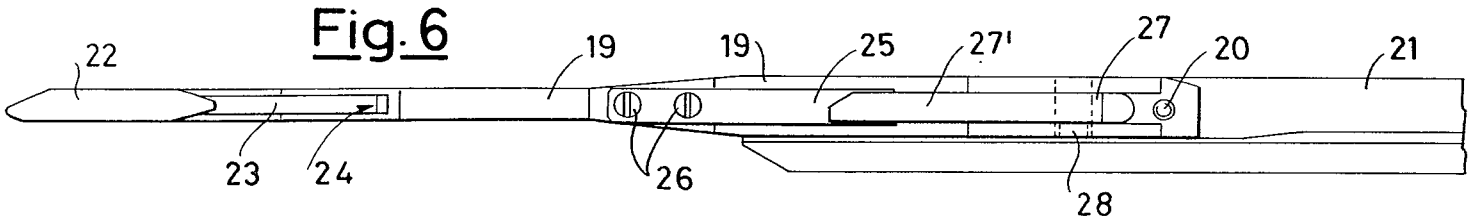
FIG. 6 is a longitudinal side view of a weft withdrawing gripper using gripping and clamping members according to the invention.
Figure 7:
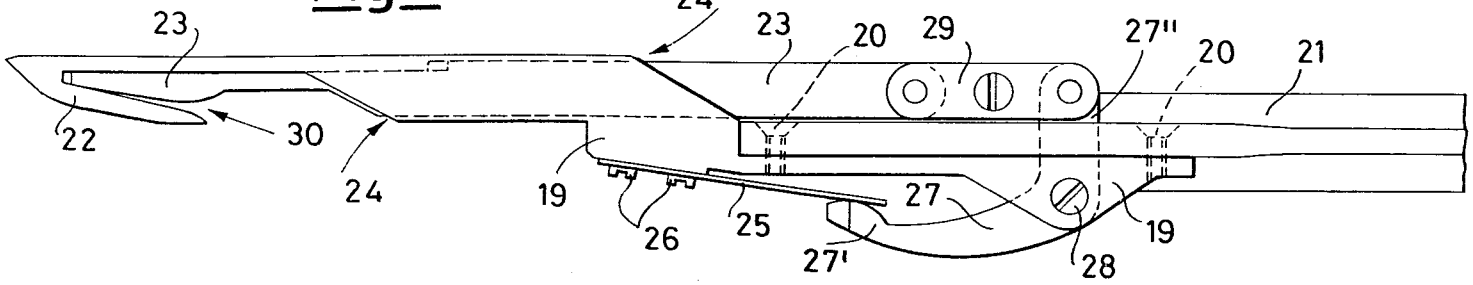
FIG. 7 is a plan view of the withdrawing gripper of FIG. 6.
Figure 8:
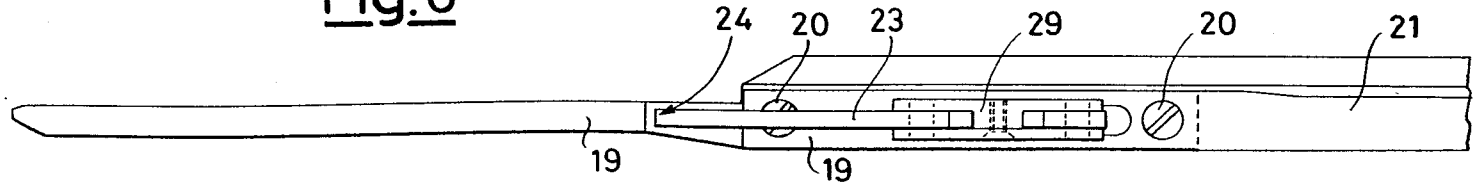
FIG. 8 is a longitudinal view taken on the side opposite that of FIG. 6 of the weft withdrawing gripper.
Figure 9:
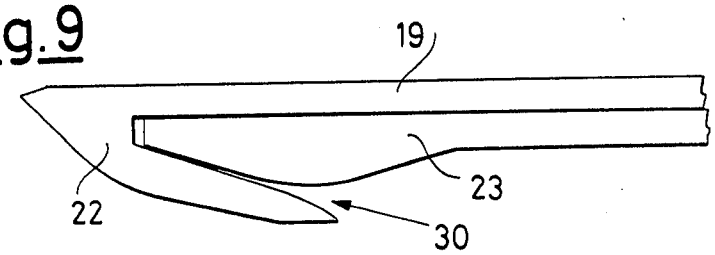
FIG. 9 is a plan view of the hook-wedge system of the weft withdrawing gripper according to the invention when in its closed position.

According to a modification shown in FIGS. 4 and 5, the blade-type foot 7 is kept resting against the gripping surface 6 by a thrust spring 13 which presses against the inclined face of the foot 7 and is inserted through a slot 14 present in said foot so that it extends to the rear of the foot by its part 13' to beyond the edge of said slot 14. The thrust spring 13 is kept pressed against the inclined face of the foot 7 by a lever 15 which is hinged at its centre to the gripper body 1 by means of the vertical rotation pin 16 and is opposed by the return spring 17 which acts between a fixed part of the gripper body 1 and that arm 15' thereof which projects from the gripper body, said lever carrying said thrust spring 13, which is fixed to its other arm 15'' by screws 18.

Figure 10:
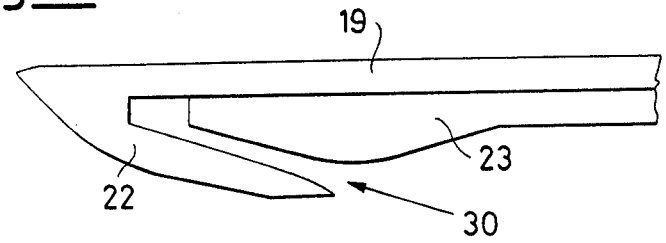
FIG. 10 is a view similar to that of FIG. 9 but with the hook-wedge system in its open position.

The weft withdrawing gripper comprises a gripper body 19, one end of which is screwed by screws 20 to the support 21 whereas its other end terminates in a hook 22 disposed horizontally. A mobile wedge 23 can slide axially within the hook 22 and is inserted in an axial guide cavity 24 in the gripper body 19, and is kept resiliently pressed within said hook 22 by a spring 25 which is fixed by screws 26 to the gripper body 19 and acts on that end 27', projecting from the gripper body 19, of a lever 27 pivoted at its centre to the gripper body 19 by means of the vertical rotation pin 28, to its other end 27'' there being hinged the end of said mobile wedge 23 by means of the connecting bar 29. The hook 22 and wedge 23 are shaped in such a manner that they form a narrow V inlet 30 between them on one side, and into which the weft yarn is inserted and locked. The weft yarn is released by positively acting with a cam such that said lever 27 is rotated clockwise against the action of the spring 25, so that the wedge 23 is compelled to move axially towards the right and thus to open the V inlet 30, as shown in FIG. 10.

Figure 11:
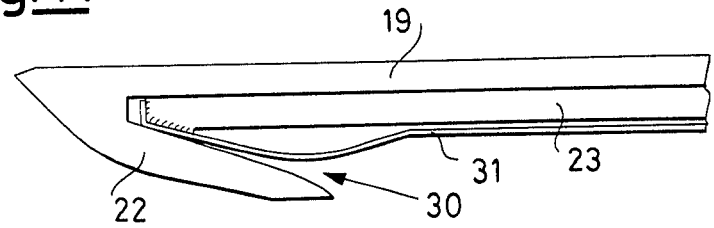
FIG. 11 is a plan view of a modification of the hook-wedge system of the weft withdrawing gripper according to the invention in its closed position.
Figure 12:
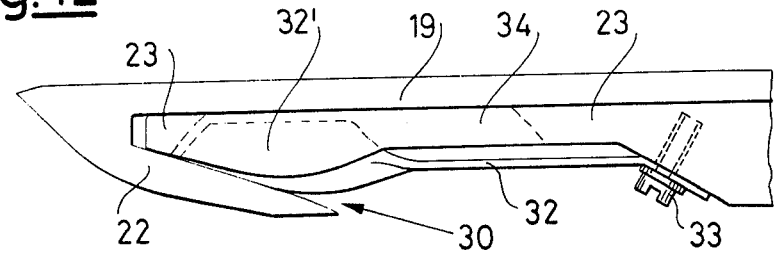
FIG. 12 is a view similar to that of FIG. 11 according to a further embodiment of the invention.

Finally, FIGS. 11 and 12 show embodiments of the invention arranged to increase the clamping of the weft yarn by the withdrawing gripper, and for this purpose the wedge 23 is provided at said V inlet 30 with a flat spring welded thereto (see FIG. 11) or with a flat curved spring 32 (see FIG. 12), one end of which is fixed by screws 33 to the wedge 23, whereas its other twisted end 32' is inserted through a narrow slot 34 provided in said wedge 23 on the side facing said hook 22.

I claim:

1. Weft inserting and withdrawing grippers for a shuttleless loom, each comprising a gripper body provided with weft yarn gripping and clamping members, characterised in that said weft yarn gripping and clamping members of the weft inserting gripper are constituted by a vertical blade-type foot which is hinged upperly to a rotation pivot supported by the inserting gripper body and disposed parallel to an underlying horizontal gripping surface, and cooperates with said gripping surface present longitudinally on the outer side of the inserting gripper, said blade-type foot having a height greater than the distance of said rotation pivot from said gripping surface, and such as to cause it to form with the gripping surface an angle approximately equal to the complementary of the angle of friction between the yarn and gripping surface, and being kept resting against said gripping surface and inclined outwards from the outer side of the inserting gripper by means of a thrust spring which is supported by the inserting gripper body and presses against its inclined face, and an arcuate deflector for the weft yarn, which descends inside the inserting gripper body until it reaches the level of said horizontal gripping surface.

2. Weft inserting and withdrawing grippers as claimed in claim 1, characterized in that said vertical blade-type foot is kept resting against the horizontal gripping surface by means of a thrust spring which is pressed against the inclined face of the foot by a lever opposed by a return spring and projecting from the gripper body, and is inserted through a slot provided in said blade-type foot so that it extends behind the foot to beyond the edge of said slot.

3. Weft inserting and withdrawing grippers as claimed in claim 1, characterised in that said weft yarn gripping and clamping members of the weft withdrawing gripper are constituted by a wedge which is mobile axially within a hook disposed horizontally on the withdrawing gripper body, said wedge being kept resiliently pressed within said hook by a spring which acts on that end of a lever which extends outside the withdrawing gripper body, said lever being hinged at its centre to the withdrawing gripper body, the end of said wedge being hinged to the other end of said lever, said hook and said wedge being shpaed in such a manner that they form a narrow V inlet between them on one side.

4. Weft inserting and withdrawing grippers as claimed in claim 3, characterized in that in the part thereof which forms said V inlet with said hook, said wedge is provided with a flat spring rigid therewith.

5. Weft inserting and withdrawing grippers as claimed in claim 3, characterised in that in the part thereof which forms said V inlet with said hook, said wedge is provided with a spirally twisted flat spring disposed longitudinally, one of its ends being bolted to said wedge whereas its other twisted end is inserted into a slot provided in said wedge at said V inlet, and presses by way of its edge against said hook.

* * * * *